United States Patent [19]

Arnold et al.

[11] Patent Number: 4,608,483

[45] Date of Patent: Aug. 26, 1986

[54] HEATER FOR A DRUM

[76] Inventors: Richard N. Arnold, 67 Shattuck St., Springfield, Mass. 01109-3065; Haynie Harris, 515 Hancock St., Springfield, Mass. 01105

[21] Appl. No.: 712,417

[22] Filed: Mar. 15, 1985

[51] Int. Cl.[4] ..... H05B 3/26; G10D 3/02

[52] U.S. Cl. ..... 219/201; 84/411 R

[58] Field of Search ..... 219/200, 201; 84/411–422

[56] References Cited

U.S. PATENT DOCUMENTS 1,020,378 3/1912 Wanamaker ..... 84/413

2,617,325 11/1952 Astle ..... 219/201

2,655,071 10/1953 Levay ..... 84/411 R

*Primary Examiner*—Clarence L. Albritton

*Assistant Examiner*—Teresa Walberg

*Attorney, Agent, or Firm*—Ross, Ross & Flavin

[57] ABSTRACT

A mechanism for heating the head of a percussion drum includes a pair of membranes disposed in tight adjacency to each other and tautly held with respect to the annular drum wall and a wire loop electrically connected to an external source of electricity and being tightly sandwiched concentrically between the membranes for insuring heat dissipation radially outwardly and inwardly therefrom with a minimization of the heat being lost to ambient air before the primary purpose of thorough membrane heating has first been realized.

1 Claim, 3 Drawing Figures

HEATER FOR A DRUM

BACKGROUND OF THE INVENTION

1. Field of the Invention

The invention relates to a percussion instrument consisting of a hollow shell or cylinder with a drumhead in the form of a membrane or web stretched over one or both ends that is beaten with the hands or with an instrument such as a tick or wire brush.

2. Description of the Prior Art

Drums known today have heads formed of stretched raw-hide or other sheet material which is frequently the subject of the absorption of moisture resultant in its looseness vis-a-vis tautness and/or its loss of vibratory resonance.

SUMMARY OF THE INVENTION

The primary purpose of this invention is to provide a heating mechanism for the purposes of heating the drumhead with a minimum of loss of the generated heat to the ambient air before the desired states of tautness and vibratory resonance have been attained or retained, as the case may be.

It is another object to provide a mechanism which will have no adverse effect with respect to the drum tone.

DESCRIPTION OF THE PREFERRED EMBODIMENT

Figure 1:
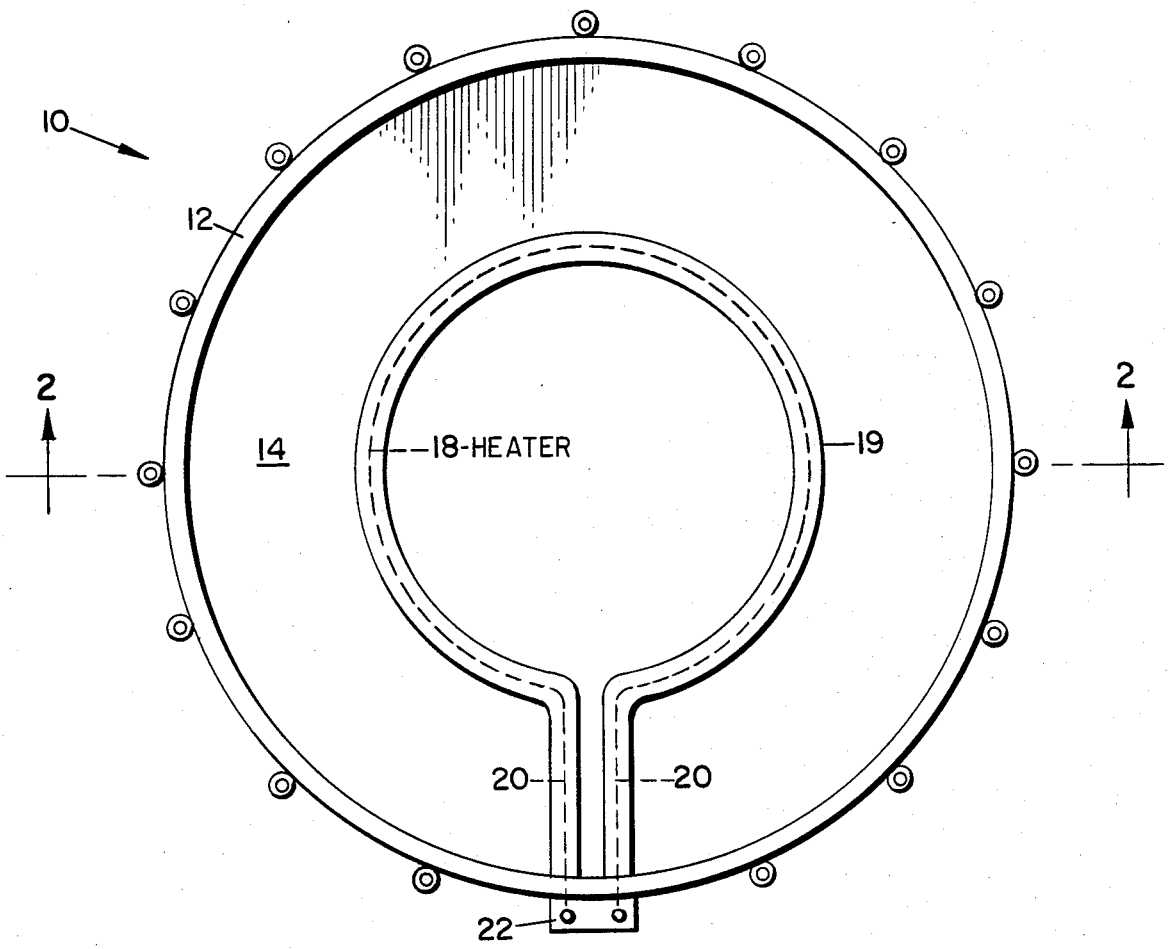
FIG. 1 is a view in top plan of the head of a conventional drum.
Figure 2:
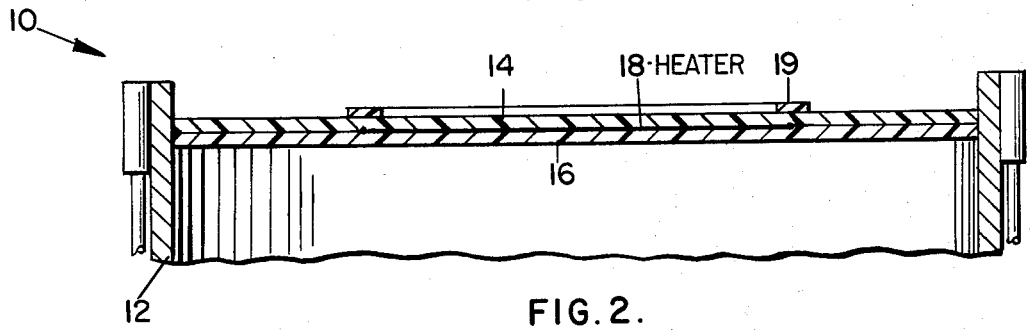
FIG. 2 is a sectional view on line 2—2 of FIG. 1.
Figure 3:
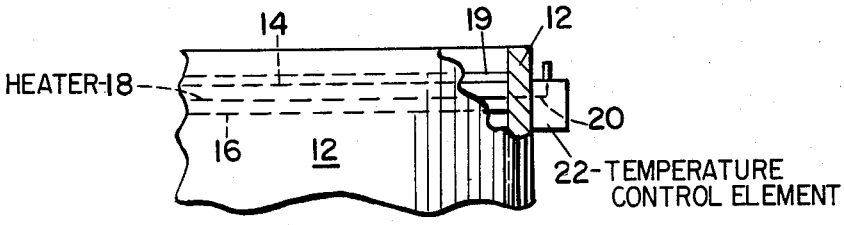
FIG. 3 is a fragmentary view of the joinder of the heating ring showing its connection to the drum exterior.

A typical percussion drum is denoted generally by 10 and includes an annular cylindrical wall 12 having an end closed by a pair of tightly stretched coplanar sheet membranes or webs, an outer membrane 14 and an inner membrane 16, each being secured to the wall circumference in any of the conventional ways in order to assure the tautness so obviously imperative in such an instrument.

Tightly sandwiched between the two membranes and disposed in concentricity relative thereto is a ring of wire 18.

At one side of the ring its spaced opposite ends 20 are turned radially outwardly in spaced parallelism with the outboard ends thereof being insulated and extended through the cylinder wall, terminating on the exterior in a temperature control element 22, and from which an appropriate conductor or lead line is extended to a source of electricity, not shown, such as a battery or a wall socket.

The function of the sandwiched ring wire is to dissipate the heat generated therewith when in operational use. That is, dissipate in the sense of spreading the heat radially outwardly and inwardly therefrom between the membranes with a minimization of heat loss upwardly or downwardly therefrom into the ambient air.

In other words, the virtue of the employment of the membranes as a cooperant pair is that a synergistic effect is obtained. Not only each membrane is heated throughout the entirety of its area, as is the primary desideratum, but also the enclosing of the wire in this manner serves to ensure a more expeditious dissemination of the heat radially, both inwardly and outwardly, with a minimization of any passage of the heat to ambient air.

On the outboard suface of outer membrane 14 a plastic ring 19 is secured as by an adhesive or other suitable material so as to overlie wire ring 18 and its terminals 20 therebelow. Same serves to protect the wire ring and terminals from any likelihood of breakage due to the forces placed upon the membranes as the result of any drume use.

I claim:

1. An electrically heated percussion drum comprising: a vertical annular wall, one end of the wall being closed by a pair of coplanar membranes secured at their adjacent circumferences to the annular wall, a heating element in the form of a wire loop disposed centrally and concentrically of and between the pair of membranes and a pair of terminals extending radially outwardly from each end of the wire loop and through the annular wall, a temperature control unit electrically connected to the outboard terminals of the heating element, and a conductor connecting the heating element and the temperature control unit to a source of electricity.

* * * * *